US009421660B2

(12) United States Patent
Stahringer et al.

(10) Patent No.: US 9,421,660 B2
(45) Date of Patent: Aug. 23, 2016

(54) POLISHING METHOD FOR MACHINING AN OPTICAL SURFACE OF AN OPTICAL LENS AND POLISHING TOOLS SUITABLE THEREFOR

(71) Applicant: OptoTech Optikmaschinen GmbH, Wettenberg (DE)

(72) Inventors: Sebastian Stahringer, Ebsdorfergund (DE); Roland Mandler, Heuchelheim (DE)

(73) Assignee: OptoTech Optikmaschinen GmbH, Wettenberg (DE)

( * ) Notice: Subject to any disclaimer, the term of this patent is extended or adjusted under 35 U.S.C. 154(b) by 13 days.

(21) Appl. No.: 14/457,142

(22) Filed: Aug. 12, 2014

(65) Prior Publication Data

US 2015/0050864 A1 Feb. 19, 2015

(30) Foreign Application Priority Data

Aug. 13, 2013 (DE) ..... 10 2013 108 766

(51) Int. Cl.

| | |
|---|---|
| ***B24B 13/02*** | (2006.01) |
| ***B24B 13/01*** | (2006.01) |
| ***B24B 13/04*** | (2006.01) |
| ***B24B 13/06*** | (2006.01) |
| ***B24B 41/00*** | (2006.01) |

(52) U.S. Cl.

CPC ..... *B24B 13/026* (2013.01); *B24B 13/01* (2013.01); *B24B 13/04* (2013.01); *B24B 13/06* (2013.01); *B24B 41/002* (2013.01)

(58) Field of Classification Search

CPC ..... B24B 13/026; B24B 13/04; B24B 13/01; B24B 13/02; B24B 13/00; B24B 13/005

See application file for complete search history.

(56) References Cited

U.S. PATENT DOCUMENTS

| | | | | |
|---|---|---|---|---|
| 4,989,316 | A * | 2/1991 | Logan | B23Q 1/4857 29/527.3 |
| 5,042,935 | A * | 8/1991 | Logan | B23Q 1/4857 351/154 |
| 5,217,335 | A * | 6/1993 | Houchens, Jr. | B24B 13/06 409/134 |
| 5,231,587 | A * | 7/1993 | Frost | B24B 13/06 451/390 |
| 6,276,994 | B1 * | 8/2001 | Yoshida | B23Q 3/157 451/41 |
| 8,727,834 | B2 * | 5/2014 | Schneider | B24B 13/005 451/146 |
| 9,004,979 | B2 * | 4/2015 | Tuecks | B24B 13/01 451/42 |

FOREIGN PATENT DOCUMENTS

| | | |
|---|---|---|
| DE | 103 33 500 | 2/2005 |
| DE | 100 31 057 | 4/2005 |

* cited by examiner

*Primary Examiner* — Dung Van Nguyen

(74) *Attorney, Agent, or Firm* — Clark & Brody

(57) ABSTRACT

A polishing method for machining an optical surface of an optical lens uses a polishing wheel which has a wheel axis and a polishing face. The polishing wheel is moved in relation to the lens over the surface of the latter along a spiral machining path. The polishing wheel is rotated about the wheel axis, and is (simultaneously) rotated about an axis of rotation oriented perpendicularly to the wheel axis. The rotational speed of the polishing wheel about the wheel axis and/or the axis of rotation is reduced at the spiral center of the movement path. A workpiece fixture for receiving an optical lens stands opposite the polishing wheel, with the workpiece fixture and the polishing wheel being mounted movably in relation to one another along a spiral movement path. The rotational speed of the wheel axis can be coupled kinematically to the rotational speed of the axis of rotation.

9 Claims, 5 Drawing Sheets

POLISHING METHOD FOR MACHINING AN OPTICAL SURFACE OF AN OPTICAL LENS AND POLISHING TOOLS SUITABLE THEREFOR

The invention relates to a polishing method for machining an optical surface of an optical lens and to polishing tools for carrying out the method.

Spectacle glasses and other optical lenses are often obtained from a lens blank by cutting machining and surface-coating machining. After the cutting machining of an optical surface, the latter has a relatively high roughness, for example 200-300 nm. This is reduced by means of subsequent polishing in order to eliminate optical errors.

However, polishing in this case serves not only for reducing the roughness, but also for giving the optical surface a fine contour. Spectacle glasses, in particular, have an irregular surface topography in order to correct various visual defects. The use of what are known as atoric lens surfaces is also known from other optical applications, such as telescopes, microscopes and photographic equipment.

Familiar polishing technologies are, inter alia, the polishing band (DE 103 33 500 A1) and the polishing wheel (DE 100 31 057 B4). According to DE 100 31 057 B4, a polishing wheel is rotated about its wheel axis and is moved over the optical surface. The polishing wheel is in this case deformed elastically by means of a working pressure, so that the polishing face of the polishing wheel lies with what is known as a footprint or spot on the surface of the lens. In addition, abrasive means, such as emery, polishing medium, diamond paste and the like, are introduced into the polishing zone.

By the pressure force and speed of advance of the polishing wheel being varied, the desired amount of material removal is achieved. Advance mostly amounts to about 0.01 m/s, whereas the rotating polishing face of the polishing wheel moves at about 7 m/s in relation to the surface. Material removal is therefore brought about almost exclusively as a result of the rotational speed and the pressure force of the polishing wheel, whereas the amount of material removal is set by the advance and the pressure force of the polishing wheel. For this purpose, before the start of polishing, a removal footprint is prepared, which serves as basic information for the removal rate. Based on this, a speed profile for advance along the movement path is calculated. The speed of advance is low where a large amount of material is to be removed. Conversely, it is high in the places where a small amount of material is to be removed. As a result, the surface is thus brought to the desired topography and surface roughness is reduced.

The problem in the prior art is that the surface roughness (in the case of hard brittle materials) can be reduced to a minimum of 4-7 nm.

Moreover, a considerable problem arises when a spiral movement path of the polishing wheel over the surface is selected. A high optical error occurs here at the centre. Since ultimately only a single point is to be machined at the lens centre/spiral centre, that is to say only the diameter of the footprint of the polishing wheel, an excessively large and scarcely controllable amount of material is removed here. This is also due, in particular, to the reduced speed of advance before the polishing wheel is lifted off at the spiral centre. As a result, the error at the lens centre amounts to about 7-10 times the polishing capacity of the polishing wheel. Thus, in the case of a polishing capacity of 10 μm, a crater with a depth of 70-80 μm (centre error) regularly occurs.

In the prior art, therefore, a meander-like movement path, that is to say a path corresponding to a rectangular function, is selected almost exclusively. Such a path has no centre presenting a problem, such as that described above. However, other optical errors occur on the surface. To be precise, the grid movement of the polishing wheel generates here linear polishing lines which are mapped on the workpiece as a kind of mid-frequency (mid-spatial frequency). These track grooves, with the spacing of 1 mm to 2 mm, are too large to be able to be designated as roughness and too small to be able to correct individually by means of a tool. Furthermore, the mid-frequencies can be smoothed out only with great difficulty, since they are anchored very stubbornly into the surface memory of the workpiece and also have material variations, what are known as stress deformations, beneath the surface. In addition, in the case of a meander-like movement path, the micro-roughness generated is oriented linearly.

However, a surface generated in this way does not satisfy the requirements of high-precision optical lenses. Surface roughnesses of less than 2 nm, preferably even below 1 nm, are required here. Moreover, undirected micro-roughnesses are necessary and mid-frequencies are optically unfavourable.

In the prior art, therefore, it is necessary for the polished lenses to also subsequently undergo further smoothing. This is highly complicated. At the same time, it leads to scarcely controllable levellings of surface structures, so that the surface structure deviates from the desired topography.

In DE 100 31 057 B4, an attempt is made to avoid additional smoothing by superposing upon the meander-like movement path a circular movement, in particular an orbiting movement of the polishing wheel in relation to the lens. The orbiting radius is in this case smaller than the distance between two adjacent parallel meander runs. However, the mid-frequencies cannot thereby be smoothed out entirely.

EP 0 512 988 B1 takes a different approach. Here, the wheel axis is mounted on a fork rotatable about an axis of rotation which is oriented perpendicularly to the wheel axis and to the workpiece surface. In this case, an electric drive is integrated in the fork in order to be able to rotate the polishing wheel about the wheel axis. The axis of rotation is driven by a second electric motor. A further rotation about the axis of rotation is consequently superposed upon the rotation of the polishing wheel about the wheel axis. The disadvantage of this, however, is the large mass of the rotating fork and also oscillations of the fork. The latter arise, in particular, as a result of the suspension of the electric motor in the fork and generate different vibrations as a function of the rotational speed about the axis of rotation and the rotational speeds of the rotor of the electric motor and of the polishing wheel. These lead to incalculable material removal, and therefore the generated surface of a lens has dimensional inaccuracies.

Furthermore, power transmission from the stationary tool part into the rotating fork has to be provided. This is technically complicated, costly and susceptible to wear.

The object of the invention is, therefore, to eliminate the disadvantages of the prior art and to provide a method and a device, by means of which contour-giving and surface-coating polishing of a lens is possible with high dimensional accuracy, low surface roughness and high optical quality. At the same time, these are in each case to be simple to handle, reliable to operate and cost-effective.

The invention relates to a polishing method for machining an optical surface of an optical lens, with a polishing wheel which has a wheel axis which is surrounded radially by a polishing face, and in which the polishing face of the polishing wheel is laid onto the surface of the lens, the polishing wheel is moved in relation to the lens over the surface of the latter along a spiral machining path, the polishing wheel is rotated about the wheel axis, and the polishing wheel is (simultaneously) rotated about an axis of rotation which is oriented perpendicularly to the wheel axis, and in which the rotational speed of the polishing wheel about the wheel axis and/or the axis of rotation is reduced at the spiral centre of the movement path.

The advantage of spiral machining is that no linear mid-frequencies are generated. Moreover, rotating the polishing wheel about the wheel axis and the axis of rotation avoids the linear micro-roughnesses. Machining preferably takes place in this case from the lens circumference in the direction of the lens centre. As a result of the reduced rotational speed at the lens centre, an optical error caused by the excessive removal of material at the centre of the lens is reduced or avoided. The polishing wheel is preferably to be lifted off from the surface of the lens at the spiral centre. Consequently, by virtue of this method, lenses with high optical quality, in particular even spectacle glasses, can be manufactured. Both lenses made from glass and lenses made from plastic can be machined by the method.

During machining, the wheel axis should (always) be oriented essentially parallel to the surface of the lens. In other words, the wheel axis is then a parallel to the tangential plane at the footprint of the polishing wheel or the axis of rotation is a perpendicular to the tangential plane. As a result, the footprint is always formed identically and has no non-uniform one-sided pressure points. Uniformly high dimensional accuracy and low surface roughness are consequently achieved.

Since the lens surface to be machined is typically concave or convex, the spiral machining path may also be designated as a (conical/cone-like) three-dimensional spiral. However, the third dimension in the axial direction of the axis of rotation is mostly very small in relation to the lens diameter, which is why the term "spiral" is used in this application.

So that all regions between two spiral turns are polished, a design of the spiral at least approximating to an Archimedean spiral is to be preferred. In such a design, the distance between two adjacent spiral turns is as far as possible constant. The distance between two spiral turns should in this case be (somewhat) smaller than the diameter of the footprint of the polishing wheel.

The method may be preceded, for example, by the steps:

- production of a (rough) lens by means of a shaping and non-cutting production method, and/or
- machining of a lens by cutting machining, such as milling, lathe-turning and grinding.

The method according to the invention may be followed by methods for the surface coating, surface treatment and outer contouring of the lens, for example for the production of a metallized lens, a hardened lens and/or a spectacle glass contour.

In a special refinement of the invention, there is provision whereby the rotational speed of the polishing wheel about the wheel axis and/or the axis of rotation at the spiral centre of the movement path is reduced in comparison with a rotational speed of the polishing wheel about the wheel axis and/or the axis of rotation at the outer radius of the spiral of the movement path. Consequently, the rotational speed at the critical spiral centre is also absolutely lower than on the outer radius, even when the selected rotational speed in a region of the movement path between the outer radius and the spiral centre is higher for technical reasons than on the outer radius, for example in order to achieve especially high material removal in regions.

A method variant is to be especially preferred in which the selected rotational speed of the polishing wheel about the wheel axis and the axis of rotation at the spiral centre of the movement path is lower than on the outer radius of the spiral of the movement path. Thus, the relative speed between the surface of the lens and the polishing face is effectively reduced. At the same time, uniform micro-roughness can be achieved. A lens error at the centre of the lens can be reduced or prevented especially effectively by means of a method version in which the rotational speed of the polishing wheel about the wheel axis and the axis of rotation at the spiral centre of the movement path is reduced at least approximately to zero. Since the mid-point of the machining face no longer presents any removal volume, it is sufficient to travel over this location at a very low polishing speed. Only after the polishing wheel has come at least almost to a standstill should it be lifted off from the surface of the lens. Since the rotational speed or rotational speeds of the polishing wheel and therefore the material removal is very greatly reduced at the spiral centre, there is no need for the polishing wheel to be lifted off abruptly at the spiral centre. The selected actuators which cause lift-off can be correspondingly small and slow. Their costs are therefore low. Material removal at the spiral centre can nevertheless be predicted and set very accurately. Lenses without a centre error and with high optical quality are obtained.

Furthermore, a procedure is advantageous in which the rotational speed of the polishing wheel about the wheel axis and the axis of rotation is according to a function reduced from the outer radius of the spiral of the movement path in the direction of the spiral centre. This results in slow and uniform variations in material removal per unit time; high surface quality is also consequently obtained. The rotational speed-reducing function may have superposed upon it a material removal function which adapts the rotational speed to the amount of material removal desired.

Since the optical error occurs, overall, at the centre of the spiral, it is especially beneficial if the rotational speed of the polishing wheel about the wheel axis and the axis of rotation is (greatly) reduced exponentially in the region of the spiral centre and in the direction of the spiral centre of the movement path. Consequently, high material removal can continue to be achieved in the outer region of the spiral as a result of high rotational speeds of the polishing wheel, and significant reductions in the rotational speeds occur only at the centre of the spiral in order to prevent a centre error.

According to a special refinement of the method, the polishing wheel is pressed with a constant pressure force against the surface of the lens along the movement path. As a result of this measure, the material removal or the polishing capacity can be pre-calculated very simply and exactly. Material removal depends on a multiplicity of parameters; inter alia, on the pressure force of the polishing wheel, on the rotational speeds about the wheel axis and axis of rotation, on the speed of advance along the machining path, on the state of the polishing face and polishing means and on the material of the lens. Reducing the variant parameters to sometimes invariable (that is to say, constant) parameters affords simplifications in the calculation and ultimately leads to an improved optical property of the lens.

Preferably, the action of force takes place in a spring-elastic manner, and, especially preferably, by virtue of the elastic configuration of a basic body of the polishing wheel, this said basic body carrying the polishing face. Springing therefore takes place as closely as possible beneath the polishing face and there are only insignificant mass inertias. High dimensional accuracy and low surface roughnesses can thereby be achieved.

To set the polishing capacity and therefore the material removal, it is especially beneficial to regulate the speed of advance along the movement path; preferably, on the outer radii of the spiral movement path, solely by means of the speed of advance. The speed of advance can then be reduced in the direction of the spiral centre. According to the method, an excessive removal of the material is counteracted effectively by a reduction in the rotational speeds of the polishing wheel about the wheel axis and the axis of rotation. A machine control unit is suitable for calculating and regulating the rotational speeds and speeds of advance.

A further development of the method, in which the polishing wheel is rotated at a fixed rotational speed ratio about the wheel axis and the axis of rotation, also contributes to the simplified calculation of material removal. Accordingly, the ratio between the linear polishing movements as a result of rotation about the wheel axis and the rotating polishing movements as a result of rotation about the axis of rotation is constant. As a result, the polishing capacity over the area of the footprint can be predicted in a simple way and a homogeneous polished surface is obtained.

Furthermore, such a method refinement with rotational speed coupling makes it possible to configure the polishing wheel with low rotational inertias, with the result that rapid rotational speed changes, particularly at the spiral centre, become possible (cost-effectively) for the first time. Moreover, fixed rotational speed coupling makes it possible to have simple, cost-effective and oscillation-freely rotating configurations of the polishing wheel, including machine, with the result that the dimensional accuracy and the surface roughness of the machined surface are especially good.

According to a more detailed refinement of the invention, the rotational speeds of the wheel axis and of the axis of rotation are coupled to one another kinematically. The rotational speed ratio therefore does not have to be kept constant by complicated regulation. Moreover, a single drive unit, in particular, an (electric) motor, can rotate the polishing wheel in both directions of rotation, and accordingly a second drive unit is unnecessary.

A more detailed method arrangement, which provides for the drive of the polishing wheel about the wheel axis to be brought about passively by an active drive, preferably an (electric) motor, or the axis of rotation, also contributes to this. Consequently, only one active drive is necessary and the relevant costs are low. The active drive may accordingly be positioned in a stationary, that is to say non-corotating, manner. The rotational mass is then low, and few oscillations are transmitted from the drive to the polishing wheel.

In practical tests, a method execution proved to be especially beneficial in which the polishing wheel is rotated twice to 10 times, preferably 3 times to 9 times, and especially preferably 4 times to 8 times, as quickly about the wheel axis as about the axis of rotation.

Furthermore, a particular conduct of the polishing method provides for the polishing wheel to be rotated about the axis of rotation in a balanced manner. Possible oscillations of the polishing wheel are consequently reduced to a minimum and high dimensional accuracy and low surface roughnesses are achieved. In addition, high rotational speeds about the axis of rotation are possible.

Furthermore, the lens can be rotated during the polishing method, in particular about a workpiece axis. This should be centred essentially parallel to the axis of rotation when the centre of the optical lens is being machined. To generate the spiral movement path, it is then sufficient to have an additional linear displacement of the polishing wheel in relation to the lens in a plane perpendicular to the workpiece axis. For this purpose, either the polishing wheel is displaced linearly or the rotating lens is displaced linearly. Where convex and concave lenses are concerned, the third dimension must be taken into account by a feed between the polishing wheel and lens.

Moreover, the method may be supplemented to the effect that a rotating movement is superposed upon the movement path. The radius of the superposing rotation should in this case be smaller than the distance between two adjacent runs of the movement path. This results in a further-improved optical property of the lens due to reduced directed microroughnesses. This rotating movement can be brought about by an orbiting movement of the axis of rotation in relation to the lens. In principle, the axis of rotation can orbit or circle about a mid-axis. Preferably, however, the lens is orbited about an orbit axis which is parallel to the axis of rotation.

The invention relates, moreover, to a polishing tool, in particular for carrying out a polishing method, as described above, with a polishing wheel which has a wheel axis which is surrounded radially by a polishing face, the wheel axis being mounted on an axis of rotation and the wheel axis being oriented perpendicularly to the axis of rotation, and with a workpiece fixture, standing opposite the polishing wheel, for receiving an optical lens, the workpiece fixture and the polishing wheel being mounted, preferably driven, movably in relation to one another along a spiral movement path.

By means of such a device, the above-described advantages of the method can be implemented; this, in particular, being due to the spiral movement path, with a simultaneous rotation of the spiral wheel about the wheel axis and axis of rotation. High-quality lenses can consequently be produced by means of the device.

In a more detailed refinement of the invention, there is provision whereby the workpiece fixture is mounted rotatably about a workpiece axis. Consequently, not all the movements of the movement path have to be brought about by the active movement of the polishing wheel. The rotation of a rotationally symmetrical lens which is light in relation to the polishing wheel is highly uniform and smooth, so that few oscillations arise. Moreover, the speed of advance along the movement path can be brought about by a rapid change in the rotational speed of the workpiece fixture which has low mass. The polishing quality is especially high as a result. The workpiece axis should in this case correspond to the optical axis of an optical lens received. The workpiece axis is then oriented essentially parallel to the axis of rotation of the polishing wheel, especially when the centre of the optical lens is being machined. Beyond the centre of the optical lens, the axis of rotation is preferably oriented as a perpendicular to the surface of the lens. In addition, the polishing wheel or workpiece fixture should be mounted so as to be displaceable linearly in a plane perpendicular to the second axis of rotation. By the rotation of the lens and the linear movement being superposed, the spiral movement path can be traveled over.

In a preferred refinement of the invention, the rotational speed of the wheel axis is coupled kinematically to the rotational speed of the axis of rotation, preferably with a fixed rotational speed ratio.

As a result, the material removal rate/polishing capacity can be calculated very simply, since the ratio between the linear polishing movements due to rotation about the wheel axis and the rotating polishing movements due to rotation about the axis of rotation is constant. Moreover, by virtue of the rotational speed coupling, a refinement of the polishing wheel with low rotational inertias is possible, since a motor rotating with the polishing wheel may be dispensed with. This makes it possible to have rapid rotational speed changes which contribute, particularly at the spiral centre, to a lens surface without centre error.

With fixed rotational speed coupling, it is possible to have a simple, cost-effective and oscillation-freely rotating configuration of the polishing wheel, including machine, thus improving the machining quality of the surface. Complicated regulation to a constant rotational speed ratio may be dispensed with on account of the kinematic (mechanical) coupling. The kinematic coupling should have a rotational speed ratio in which the polishing wheel rotates twice to 10 times, preferably 3 times to 9 times, and especially preferably 4 times to 8 times, as quickly about the wheel axis as about the axis of rotation. Especially good polishing capacities in terms of quality and quantity are thereby achieved.

Owing to the kinematic coupling, a single drive unit, in particular an (electric) motor, is sufficient for exciting the polishing wheel to rotate in both directions of rotation. A refinement also contributes to this which provides for the drive of the polishing wheel about the wheel axis to be brought about passively by an active drive, preferably with an (electric) motor, of the axis of rotation. Consequently, only one active drive is necessary and the relevant costs are low. The active drive can accordingly be positioned in a stationary, that is to say non-corotating, manner.

The invention relates, moreover, to a polishing tool, preferably for carrying out a polishing method, as described above, with a polishing wheel which has a wheel axis which is surrounded radially by a polishing face, the wheel axis being mounted on an axis of rotation and the wheel axis being oriented perpendicularly to the axis of rotation, and the rotational speed of the wheel axis being coupled kinematically to the rotational speed of the axis of rotation, preferably with a fixed rotational speed ratio.

The rotational speed coupling makes it possible, in turn, to have a simple, cost-effective and oscillation-freely rotating configuration of the polishing wheel, including machine. At the same time, high dimensional accuracy and low surface roughness of the machined surface are achieved.

A special advantage is, furthermore, that the polishing wheel can be coupled (for example hydraulic expansion connection/chuck) to a (standardized) fixture of a machine, in order to cause excitation to rotation. To be precise, according to the invention, only one drive motor is required on the machine side and there is no need for the supply of power to the rotating parts. The polishing wheel can consequently be retrofitted and exchanged simply and cost-effectively, the machines used still remaining convertible for machining work with other tools. To implement the method, the spiral movement path is then to be brought about on the machine side, that is to say by movements of the tool fixture which holds the polishing wheel and the workpiece fixture which holds the lens. However, the polishing wheel according to the invention is also suitable for method refinements in which the movement path is meander-like or is designed according to a rectangular function. By the rotations about the wheel axis and about the axis of rotation being superposed, linear orientation of the micro-roughness is counteracted, as a result of which, even in this case, the optical quality of the lens is high.

The kinematic coupling is preferably encapsulated for protection against impurities.

According to a special refinement of the invention, the kinematic coupling between the wheel axis and axis of rotation is brought about at least partially via gearwheels. Gearwheels are wear-resistant, make it possible to have a broad range of step-up ratios and allow low-oscillation force transmission. Moreover, they are available in a wide selection cost-effectively as semi-finished or finished products.

According to a variant of the polishing tool, the kinematic coupling between the wheel axis and axis of rotation comprises a contrate gear or bevel gear. This does justice, in particular, to the orientations of the wheel axis and axis of rotation which are necessitated by a change in direction of the axis of rotation which can be brought about with high efficiency and low wear by means of these gears.

Furthermore, a special refinement of the invention provides for the contrate gear or bevel gear to connect the wheel axis to a second coupling means which is connectable and/or connected to a stationary machine part. There is therefore need for only one interface for securing the second machine fixture to the machine.

It is mostly possible without difficulty to provide a machine-side stationary fixture. Furthermore, the polishing tool constitutes a functional unit, the components of which are all coordinated with one another. Operating and handling errors are thus minimized.

In a variant of the polishing wheel according to the invention, the kinematic coupling between the wheel axis and axis of rotation comprises a belt drive. The advantage of a belt drive is that a longer distance between two pulleys can be bridged, so that a light-weight and compact configuration is possible. In particular, it is expedient to mount one pulley on the wheel axis, in order to obtain a slender tool in the immediate vicinity of the polishing wheel.

A version such that the axis of rotation has at the end side a one-sided single-armed fixture (stationary single-armed rocker) for the wheel axis also contributes to a slender configuration. The single-armed fixture may in this case serve as a carrier element for the kinematic coupling, for example as a bearing block for gearwheels or pulleys. High torsional rigidity is achieved if the single-armed fixture for receiving the kinematic drive is of at least partially hollow form. It is especially beneficial to utilize the single-armed fixture as part of an encapsulation of the kinematic coupling, in order to protect this against contamination.

Furthermore, in a further development of the polishing wheel, there is provision whereby the axis of rotation forms a first coupling means for a rotary drive. The polishing tool can consequently be used in a machine which, in particular, provides a drive. Suitable coupling means are, in particular, a shank, preferably cylindrical or with more than five edges, or a Morse taper. Consequently, the polishing tool is exchangeable and the machine remains convertible in respect of other tools. The costs for the polishing tool are thereby low. A hydraulic expansion chuck is used especially preferably. These are standardized, and therefore the polishing tool can be installed in a multiplicity of existing machines. A hydraulic expansion chuck has at the clamping location a metal diaphragm which is expanded by oil and thereby tensioned.

According to a special refinement of the invention, the mass centre of gravity of the rotating parts of the polishing wheel lies on the axis of rotation. In other words, the components of the polishing wheel which rotate about the axis of rotation are then balanced. Consequently, no vibrations due to an unbalance of the polishing wheel arise and the machining quality of the surface is high. Furthermore, high rotational speeds about the axis of rotation can be implemented.

The polishing face of the polishing wheel should be deformable elastically so that it can lie with a bearing face on a lens. Geometric configurations of the polishing face which may be considered are a narrow wheel shape, a cask shape, a barrel shape or a spherical shape. Independently of the shape of the polishing face, the axis of rotation should be arranged centrally with respect to this, in order to prevent an unbalance.

Further features, details and advantages of the invention may be gathered from the wording of the claims and from the following description of exemplary embodiments, with reference to the drawing in which:

Figure 1:
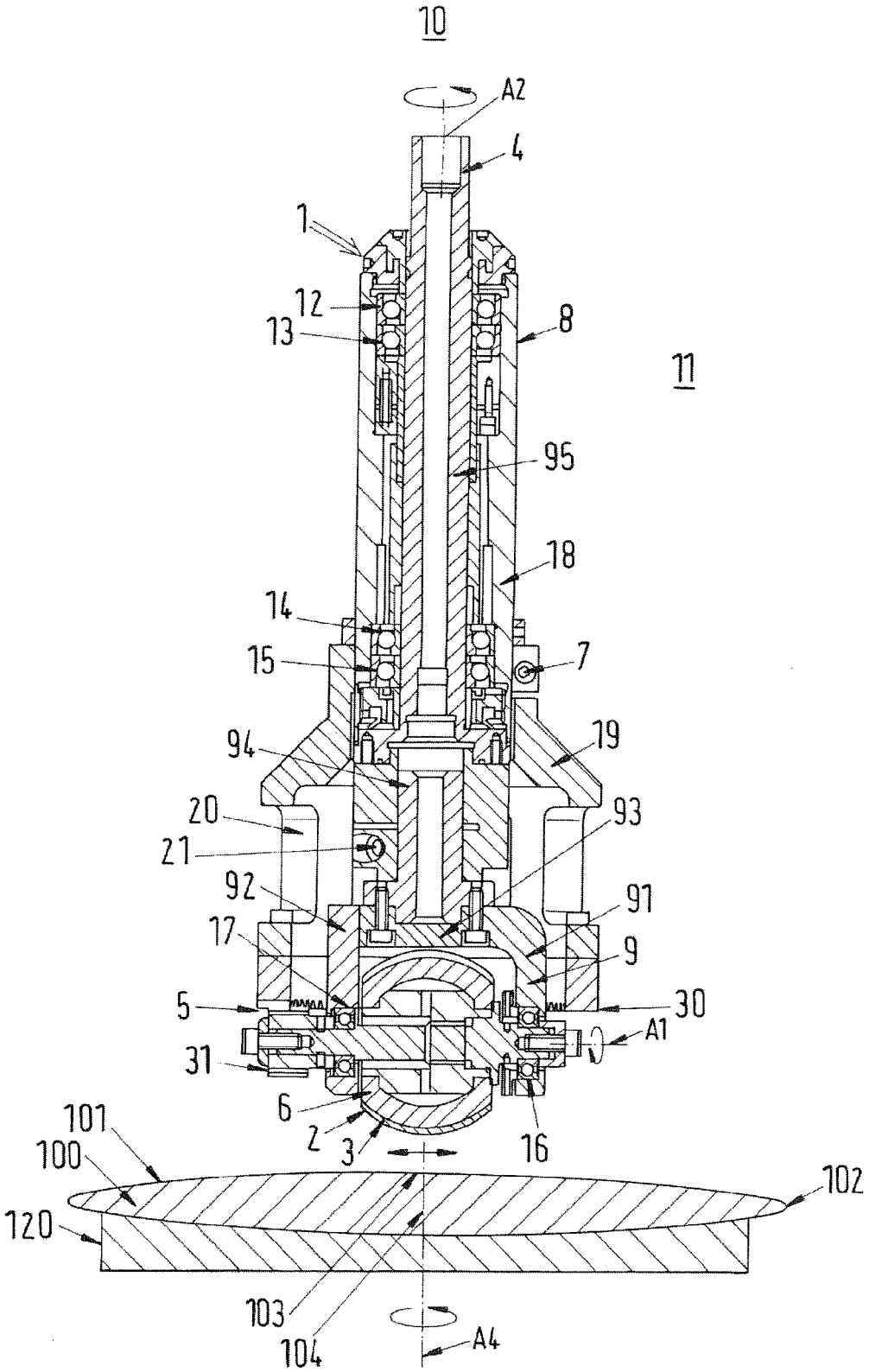
FIG. 1 shows a section through a polishing tool.

FIG. 1 shows a polishing tool 1 which can be installed in a machine tool. The polishing tool 1 has a polishing wheel 2 which can also be seen, enlarged, in a perspective view in FIG. 2.

Figure 2:
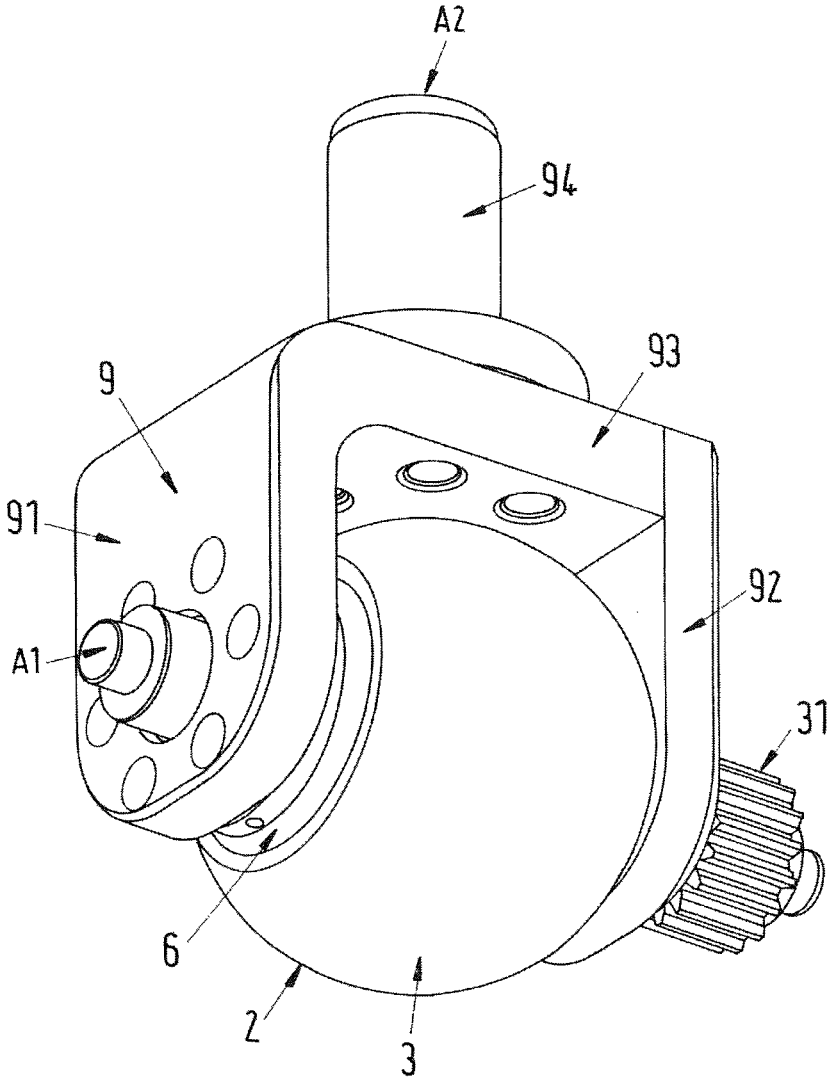
FIG. 2 shows a perspective view of a polishing wheel with fixture.

According to FIGS. 1 and 2, the polishing wheel 2 has a wheel axis A1 and a polishing face 3 radially surrounding the wheel axis A1. An elastic basic body 6 is arranged between the wheel axis A1 and the polishing face 3. The wheel axis A1 carries a second gearwheel 31 which, in particular, is plugged on and screwed tight.

Furthermore, adjacently to the basic body 6 of the polishing wheel 2, the wheel axis A1 carries on each of the two sides a ball bearing 16, 17 (not visible in FIG. 2). By means of these ball bearings 16, 17, the wheel axis A1 is mounted on a fixture 9, to be precise in a fork of an axis of rotation A2.

The axis of rotation A2 is oriented perpendicularly to the wheel axis A1 and is composed, for mounting reasons, of a plurality of axial portions. Firstly, a fork prong 92 of the fork is fastened releasably to a bridge 93 of the opposite fork prong 91. The wheel axis A1 can thereby be inserted into the fork of the fixture 9. The fork is plugged with a plug portion 94, via the bridge 93, into a (two-part) shank 95 (not illustrated in FIG. 2) of the axis of rotation A2.

As may be gathered from FIG. 1, the two axial portions of the axis of rotation A2 are connected in a rotationally fixed manner at the plug connection by means of a screw 21. The shank 95 is a spindle and forms a first coupling means 4. The polishing tool 1 can be connected to a rotary drive 10 by the first coupling means 4.

The second gear wheel 31, fixed on the wheel axis A1, matches with a first gearwheel 30 which is a contrate wheel. The first gearwheel 30 is oriented coaxially to the axis of rotation A2. There is here, therefore, a contrate gear 5. To secure the first gearwheel 30 to a stationary machine part 11 (that is to say, a machine part 11 not rotating about the axis of rotation A2), with positioning in relation to the second gearwheel 31 always being correct, the first gearwheel 30 is connected to an outer shank 18. The axis of rotation A2 is mounted inside the outer shank 18 in an axially fixed and also rotatable manner via a plurality of ball bearings 12, 13, 14, 15. The outer shank 18, too, is composed of plurality of portions for mountability. The outer shank 18 forms a second coupling means 8 by which the polishing tool 1 can be coupled to a stationary machine part 11. On the side of the polishing wheel 2, the outer shank 18 has a widened dome 19 which is fixed to the remaining outer shank 18 by means of a fixing screw 7. The dome 19 carries on its end face the first gearwheel 30. To actuate the screw 21 for securing the plug portion 94, the dome 19 has a lateral mounting orifice 20.

By the polishing tool 1 being connected via the first coupling means 4 to a rotary drive 10 and via the second coupling means 8 being connected to a rotationally fixed machine part 11, the rotational speed of the wheel axis A1 is coupled kinematically to the rotational speed of the axis of rotation A2. The rotational speed ratio in this case depends on the diameters of the first and second gearwheel 30, 31.

Opposite the polishing wheel 2 stands a workpiece fixture 120 in which an optical lens 100 is received. The workpiece fixture 120 is mounted rotatably about a workpiece axis A4 which is oriented coaxially to the optical axis 104 of the optical lens 100.

In a modification of the version shown, the gearwheels 30, 31 could be designed as bevel wheels and/or as friction wheels.

Figure 3:
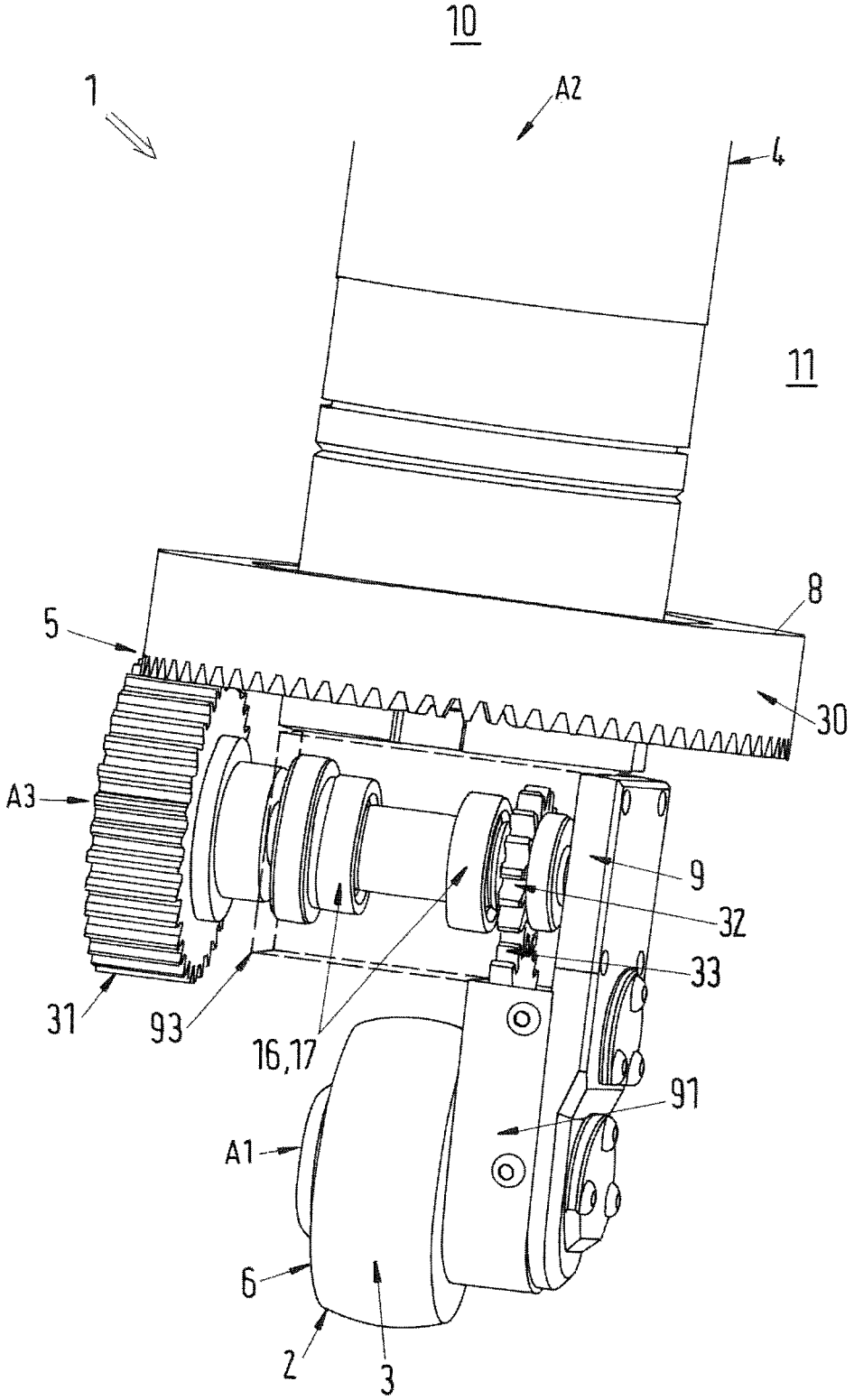
FIG. 3 shows a perspective view of a polishing tool.

Another variant of a polishing tool 1 can be seen in a perspective view in FIG. 3. In particular, the portion on the polishing-wheel side is illustrated in detail. This differs from the design variants according to FIGS. 1 and 2 in that kinematic coupling between the wheel axis A1 and axis of rotation A2 is brought about differently. Thus, although, here too, a second gearwheel 31 matches with the first gearwheel 30 (contrate wheel), nevertheless the second gearwheel 31 is not attached on the wheel axis A1. Instead, the second gearwheel 31 is fixed on a gearwheel axis A3 which runs parallel to the wheel axis A1. The gearwheel axis A3 in this case intersects the axis of rotation A2. Moreover, the gearwheel axis A3 is arranged between the first gearwheel 30 and the wheel axis A1, in particular also the polishing wheel 2. On the other side of the axis of rotation A2, the gearwheel axis A3 carries a third gearwheel 32. The third gearwheel 32 in this case has a smaller diameter than the second gearwheel 31. The rotation of the third gearwheel 32 is transmitted via a gearwheel chain to a fourth gearwheel 33 and a concealed (that is to say, not visible) fifth gearwheel. The fifth gearwheel is mounted on the wheel axis A1, so that the polishing wheel 2 is driven in rotation when the axis of rotation A2 rotates and the first gearwheel 30 is secured in a rotationally fixed manner via a second coupling means 8. The second coupling means 8 can in this case have an outer shank, as in FIG. 1.

It can be seen, furthermore, in FIG. 3 that the polishing wheel 2 is mounted on a single-armed fixture 9 of the axis of rotation A2. In this case, a fork 91 of the fixture 9 is connected to the rest of the axis of rotation A2 via a bridge 93. The bridge 93 is indicated merely by dashed lines so that internal parts can be seen. To be precise, the gearwheel axis A3 is mounted inside the bridge 93 via two ball bearings 16, 17. The gearwheel chain comprising the third to fifth gearwheel 32, 33 is mounted inside the partially hollow fork 91. This results in an especially slender front end, so that collisions with a workpiece, in particular an optical lens, are avoided.

Depending on the desired length of the fork 91 of the fixture 9, the number of gearwheels in the gearwheel chain can be adapted differently from that in the exemplary embodiment shown.

Alternatively, the gearwheel chain may be replaced by a belt drive. For this purpose, the third and fifth gearwheel are replaced in each case by a pulley. A drive belt is laid over the latter. No further gearwheels or pulleys are required in between. However, a tension roller may be provided in order to tension the belt. The tension roller is then preferably mounted resiliently.

Figure 4:
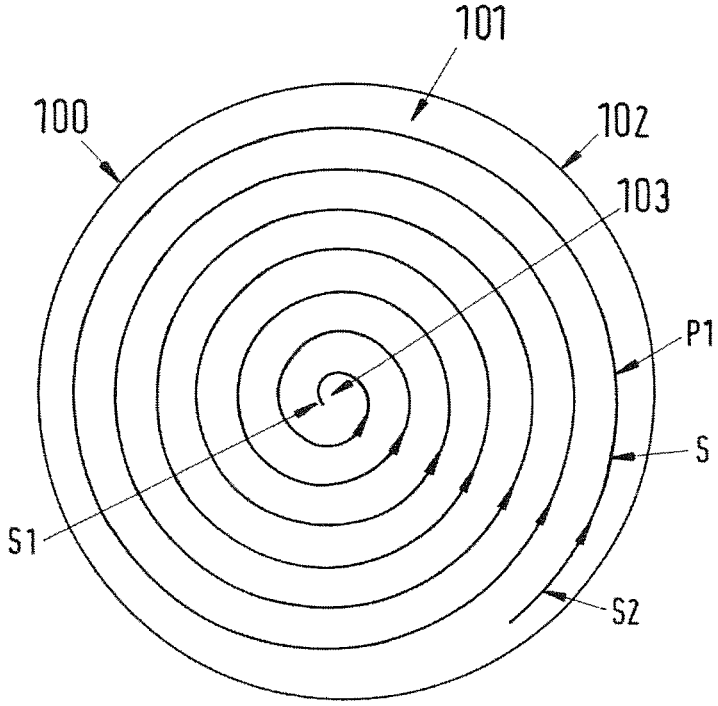
FIG. 4 shows a spiral movement path.

FIG. 4 shows an optical lens 100. This has an optical surface 101, a lens circumference 102 and a lens centre 103. Sketched on the surface 101 is a spiral machining path P1. This corresponds to an Archimedean spiral S. A third dimension, to be precise caused by a convex or concave optical surface 101, cannot be seen. Adjacently to the lens circumference 102, the spiral S of the machining path P1 has an outer radius S2. The machining path P1 leads in the form of a spiral S from the latter as far as the spiral centre S1 which lies near the lens centre 103.

Figure 5:
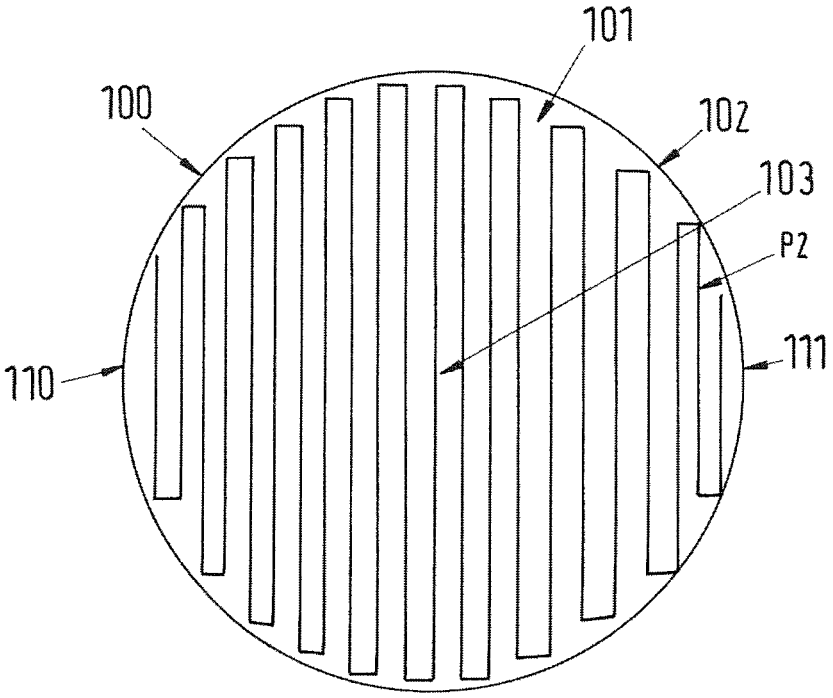
FIG. 5 shows a meander-like movement path.

In contrast to FIG. 4, FIG. 5 shows a meander-like machining path P2 which extends from an initial side 110 of the lens 100 to an end side 111 of the lens according to a rectangular function. The third dimension, in this case, again cannot be seen.

The invention is not restricted to one of the embodiments described above, but can be modified in many different ways.

All the features and advantages, including structural details, spatial arrangements and method steps, which may be gathered from the claims, the description and the drawing may be essential to the invention both in themselves and in the most diverse possible combinations.

LIST OF REFERENCE SYMBOLS

1 Polishing tool
2 Polishing wheel
3 Polishing face
4 First coupling means
5 Contrate gear
6 Basic body
7 First fixing screw
8 Second coupling means
9 (Single-armed; two-armed) fixture
10 Rotary drive
11 Non-rotating machine part
12 First ball bearing
13 Second ball bearing
14 Third ball bearing
15 Fourth ball bearing
16 Fifth ball bearing
17 Sixth ball bearing
18 Outer shank
19 Dome
20 Mounting orifice
21 Second fixing screw
30 First gearwheel
31 Second gearwheel
32 Third gearwheel
33 Fourth gearwheel
91 First fork prong
92 Second fork prong
93 Bridge
94 Plug portion
95 Shank
100 Optical lens
101 Optical surface
102 Lens circumference
103 Lens centre
104 Optical axis
110 Initial side
111 End side
120 Workpiece fixture
A1 Wheel axis
A2 Axis of rotation
A3 Gearwheel axis
A4 Workpiece axis
P1 Machining path (spiral)
P2 Machining path (meander-like)
S Spiral
S1 Spiral centre
S2 Outer radius

The invention claimed is:

1. Polishing method for machining an optical surface (101) of an optical lens (100), with a polishing wheel (2) which has a wheel axis (A1) which is surrounded radially by a polishing face (3), comprising the following steps:

laying of the polishing face (3) of the polishing wheel (2) onto the surface (101) of the lens (100), movement of the polishing wheel (2) in relation to the lens (100) over the surface (101) of the latter along a machining path (P1), rotation of the polishing wheel (2) about the wheel axis (A1), rotation of the polishing wheel (2) about an axis of rotation (A2) which is oriented perpendicularly to the wheel axis (A1), and characterized by the following step movement of the polishing wheel (2) along a spiral movement path (P1), reduction of a rotational speed of the polishing wheel (2) about the wheel axis (A1) and/or the axis of rotation (A2) at the spiral centre (S1) of the movement path (P1).

2. Polishing method according to claim 1, characterized by a reduction of the rotational speed of the polishing wheel (2) about the wheel axis (A1) and/or the axis of rotation (A2) at the spiral center (S1) of the movement path (P1) in comparison with a rotational speed of the polishing wheel (2) about the wheel axis (A1) and/or the axis of rotation (A2) at the outer radius (S2) of the spiral (S) of the movement path (P1).

3. Polishing method according to claim 1, characterized in that the rotational speed of the polishing wheel (2) about the wheel axis (A1) and the axis of rotation (A2) at the spiral center (S1) of the movement path (P1) is reduced at least approximately to zero.

4. Polishing method according to claim 1, characterized in that the polishing wheel (2) is lifted off from the surface (101) of the lens (100) at the spiral center (S1) of the spiral (S).

5. Polishing method according to claim 1, characterized in that the polishing wheel (2) is pressed with a constant pressure force against the surface (101) of the lens (100) along the movement path (P1).

6. Polishing method according to claim 1, characterized by a rotation of the polishing wheel (2) about the wheel axis (A1) and the axis of rotation (A2) with a fixed rotational speed ratio.

7. Polishing method according to claim 6, characterized in that the drive of the polishing wheel (2) about the wheel axis (A1) is brought about passively by an active drive of the axis of rotation (A2).

8. Polishing method according to claim 6, characterized in that the polishing wheel (2) is rotated twice to 10 times as quickly about the wheel axis (A1) as about the axis of rotation (A2).

9. Polishing method according to claim 1, characterized in that the polishing wheel (2) is rotated about the axis of rotation (A2) in a balanced manner.

* * * * *